US006261073B1

(12) United States Patent
Kumazawa

(10) Patent No.: US 6,261,073 B1
(45) Date of Patent: Jul. 17, 2001

(54) ROTARY COMPRESSOR HAVING BEARING MEMBER WITH DISCHARGE VALVE ELEMENT

(75) Inventor: Takeshi Kumazawa, Fuji (JP)

(73) Assignee: Kabushiki Kaisha Toshiba, Kawasaki (JP)

( * ) Notice: Subject to any disclaimer, the term of this patent is extended or adjusted under 35 U.S.C. 154(b) by 0 days.

(21) Appl. No.: 09/393,318

(22) Filed: Sep. 10, 1999

(30) Foreign Application Priority Data

Sep. 10, 1998 (JP) ..... 10-257117

(51) Int. Cl.[7] ..... F04C 18/356; F04C 29/00
(52) U.S. Cl. ..... 418/63; 418/179; 418/270
(58) Field of Search ..... 418/63, 179, 270

(56) References Cited

U.S. PATENT DOCUMENTS 4,955,797 * 9/1990 Cowen ..... 418/270
5,062,779 * 11/1991 Da Costa ..... 418/270
6,042,351 * 3/2000 Bushnell et al. ..... 418/63

FOREIGN PATENT DOCUMENTS 59-180097 10/1984 (JP) .
62-255591 * 11/1987 (JP) ..... 418/179
64-387 * 1/1989 (JP) ..... 418/179
1-300084 * 12/1989 (JP) ..... 418/179
4-159486 * 6/1992 (JP) ..... 418/179
5-79481 * 3/1993 (JP) ..... 418/63
6-2681 * 1/1994 (JP) ..... 418/63

* cited by examiner

*Primary Examiner*—John J. Vrablik
(74) *Attorney, Agent, or Firm*—Foley & Lardner

(57) ABSTRACT

In an H/A range in which the ratio H/A≧0.07, where H is the thickness of the bottom wall of a recess (8) provided with a discharge port (4) and a valve seat (9) and formed in the flange (5) of a bearing member (3,3') and A is the width of the recess (8), the smaller the ratio H/A, the greater is the coefficient of performance (COP). In an H/A range in which H/A<0.07, the COP decreases due to the leakage of the refrigerant resulting from the deflection of the bottom wall of the recess (8) and, eventually, the bearing members (3,3') are broken. The discharge port (4), the recess (8) and the valve seat (9) are formed so that the ratio H/A≧0.07 and the ratio T/B≦0.3, where T is the thickness of the valve seat (9) and B is the diameter of the discharge port (4). The valve seat (9) can be formed in the thickness T smaller than that of the valve seat of an equivalent conventional compressor, suppressing the deflection of the bottom wall of the recess (8).

7 Claims, 7 Drawing Sheets

ROTARY COMPRESSOR HAVING BEARING MEMBER WITH DISCHARGE VALVE ELEMENT

BACKGROUND OF THE INVENTION

1. Field of the Invention

The present invention relates to a compressor for a refrigeration system and, more specifically, to improvements in the dimensional relation between the recesses and a discharge port of a bearing member in a compressor for a refrigeration system.

2. Description of the Related Art

A general rotary compressor shown in FIG. 8 for use in a refrigeration system comprises a compressing mechanism 21, an electric motor 22 and a sealed case 20 containing the compressing mechanism 21 and the electric motor 22. The electric motor 22 has a rotor 24, a drive shaft (crankshaft) 2 fixed to the rotor 24 to drive the compressing mechanism 21. The compressing mechanism 21 has a pair of cylinders 1 and 1'. The drive shaft 2 is extended through the cylinders 1 and 1'. Rollers 10 are placed in the cylinders 1 and 1', respectively. The rollers 10 roll along the inner surfaces of the side walls of the cylinders 1 and 1', respectively.

A main bearing member 3 and an auxiliary bearing member 3' are disposed contiguously with the pair of cylinders 1 and 1', respectively. The bearing member 3 and the auxiliary bearing member 3' are basically similar in construction. Therefore only the bearing member 3 is shown in FIG. 9 and only the bearing member 3 will be described. As shown in FIG. 9, the bearing member 3 has a flange 5 joined to an end surface of the corresponding cylinder 1 (FIG. 8), and a bearing part 6 supporting the drive shaft 2. As shown in FIGS. 10 and 11, a discharge port 4 is formed through the flange 5. FIG. 11 is a fragmentary longitudinal sectional view taken on line XI—XI passing the center axis 6c of the bearing part 6 and the center axis 4c of the discharge port 4 in FIG. 10. As shown in FIG. 9, a discharge valve element 7 is attached to the flange 5 of the bearing member 3 to open and close the discharge port 4. A valve holder 12 is attached to the flange 5 to limit the opening of the valve element 7. A recess 8 corresponding to the discharge valve element 7 is formed in the flange 5. As shown in FIG. 11, a portion of the bottom surface 80 of the recess 8 around the outlet end of the discharge port 4 is raised to form a valve seat 9.

The conventional compressor for a refrigeration system as mentioned above has the following problems. As the thickness T (FIG. 11) of the valve seat 9 increases, the amount of the refrigerant remaining in the discharge port 4 increases after the completion of a discharge stroke. The increased amount of the refrigerant remaining in the discharge port 4 reduces the coefficient of performance (COP) of the refrigeration system and increases noise generated by the operating compressor. However, the thickness T of the valve seat 9 is equal to the thickness H of the bottom wall of the recess 8 or is greater than the same to prevent cavitation. Therefore, if the thickness T of the valve seat 9 is reduced simply, the thickness H of the bottom wall of the recess 8 is reduced accordingly. If the thickness H of the bottom wall of the recess 8 is reduced, the deflection of the bottom wall of the recess 8 due to the difference between pressures acting respectively on the opposite sides of the bottom wall of the recess 8 increases.

If the bottom wall of the recess 8 is deflected, the refrigerant leaks to further reduce the COP and it is possible that the bearing members 3 and 3' are broken. With a view to forming the valve seat 9 in a sufficient thickness T and surely preventing the deflection of the bottom wall of the recess 8, the diameter B of the discharge port 4 and the thickness T of the valve seat 9 are determined so that the ratio T/B>0.3 in the conventional compressor.

SUMMARY OF THE INVENTION

Accordingly, it is an object of the present invention to provide a compressor for a refrigeration system, comprising a bearing member having a flange provided with a recess and a valve seat having a thickness smaller than that of the valve seat of the bearing member of an equivalent conventional compressor and formed so as to suppress the deflection of the bottom wall of the recess and to prevent the breakage of the bearing part; and capable of enabling the refrigeration system to operate at an improved COP and of reducing the noise generated by the operating compressor.

According to a first aspect of the present invention, a compressor for a refrigeration system comprises a cylinder having a shape substantially resembling a circular cylinder; a drive shaft extended through the cylinder; a bearing member joined to an end of the cylinder, having a flange provided with a discharge port and a bearing part supporting the drive shaft and a discharge valve element held on the flange to open and close the discharge port; wherein the flange of the bearing member has a recess corresponding to the discharge valve element, and a valve seat formed by raising a portion of the bottom surface of the recess around the discharge port, the ratio $H/A \geqq 0.07$, where H is the thickness of the bottom wall of the recess and A is the width of the recess in a longitudinal section taken on line passing the center axis of the bearing part and the center axis of the discharge port, and the ratio $T/B \leqq 0.3$, where T is the thickness of the valve seat and B is the diameter of the discharge port.

When the flange, the recess, the discharge port and the valve seat are formed so that $H/A \geqq 0.07$ and $T/B \leqq 0.3$, the valve seat can be formed in the thickness T smaller than that of the valve seat of the bearing member of an equivalent conventional compressor without increasing the deflection of the bottom wall of the recess, the compressor improves the COP of the associated refrigeration system and reduces noise generated by the operating compressor.

In this compressor, the ratio B/A, where B is the diameter of the discharge port and A is the width of the recess, may be 0.2 or above. When the condition $B/A \geqq 0.2$ is satisfied, the deflection of the bottom wall of the recess can further reduced.

Preferably, the bearing member is formed of a material having a Young's modulus of 70 GPa or above. When the bearing member is formed of such a material, the deflection of the bottom all of the recess of the flange of the bearing member can further reduced and the reduction of the COP can be prevented.

The material having a Young's modulus of 70 GPa or above may be a cast iron, aluminum or an iron-base sintered metal.

According to a second aspect of the present invention, a compressor for a refrigeration system comprises a cylinder having a shape substantially resembling a circular cylinder; a drive shaft extended through the cylinder; a bearing member joined to an end of the cylinder, having a flange provided with a discharge port and a bearing part supporting the drive shaft; and a discharge valve element held on the flange to open and close the discharge port; wherein the flange of the bearing member is provided with a recess corresponding to the discharge valve element, a valve seat formed by raising a portion of the bottom surface of the recess around the discharge port, and a reinforcing part having a thickness greater than that of the bottom wall of the recess and formed in a portion of the bottom wall of the recess between the valve seat and the bearing part.

The thickness of the reinforcing part formed in the recess may be increased continuously toward the bearing part.

The thickness of the reinforcing part formed in the recess may be increased stepwise toward the bearing part.

In the foregoing compressors according to the present invention, the deflection of the bottom wall of the recess of the flange of each bearing member is suppressed and, consequently, the leakage of the gaseous refrigerant can be limited to the least unavoidable extent even if the compressors are used for compressing a refrigerant of a pressure higher than that of R22.

BRIEF DESCRIPTION OF THE DRAWINGS

The above and other objects, features and advantages of the present invention will become more apparent from the following description taken in connection with the accompanying drawings, in which.

DESCRIPTION OF THE PREFERRED EMBODIMENTS

Figure 1:
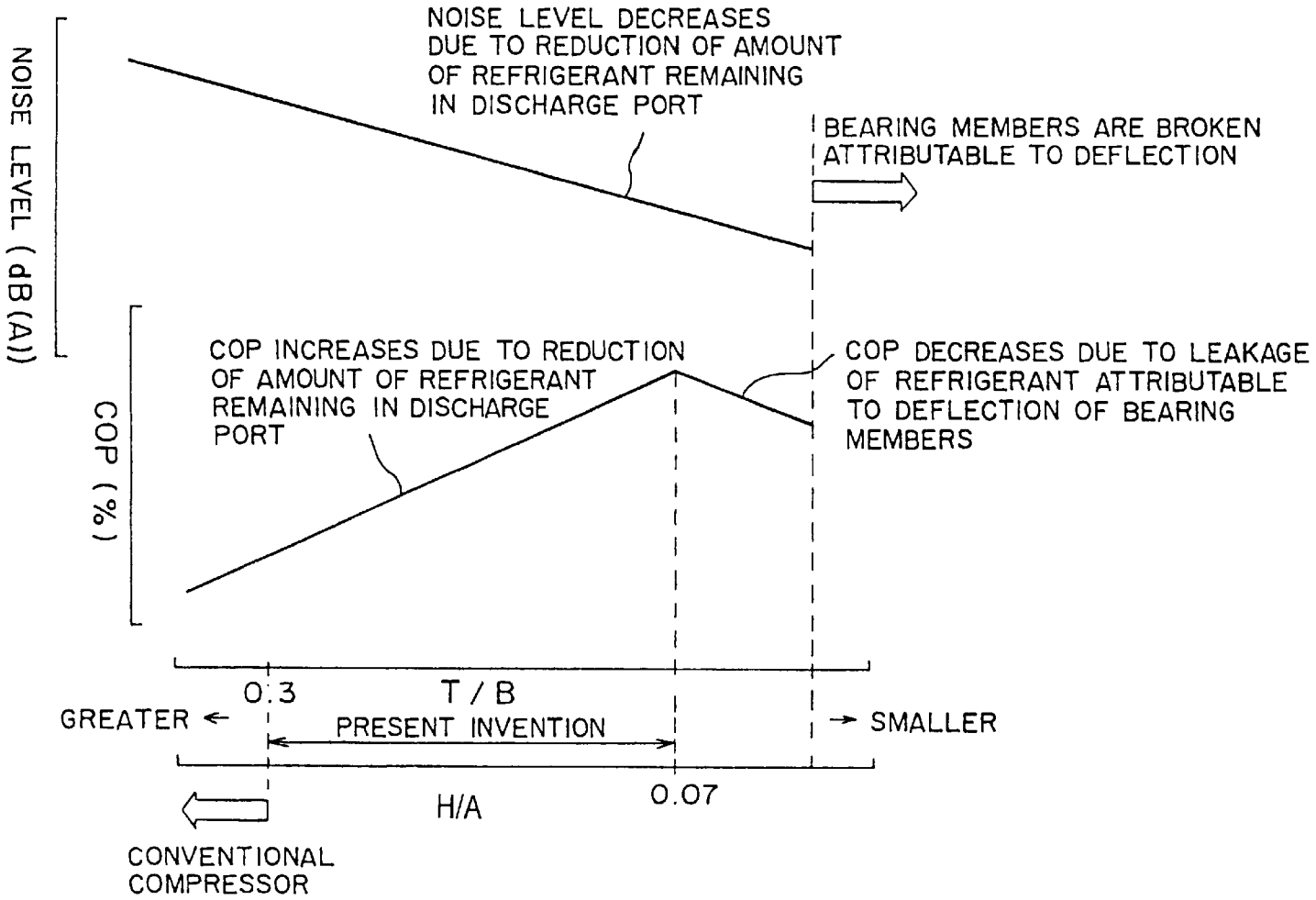
FIG. 1 is a graph of assistance in explaining a compressor in a first embodiment according to the present invention for a refrigeration system showing the relation between the ratios T/B and H/A, and COP and noise level.

Preferred embodiments of the present invention will be described with reference to FIGS. 1 to 7, in which parts like or corresponding to those of the compressor shown in FIGS. 8 to 11 are designated by the same reference characters, and reference will be made to FIGS. 8 to 11 when necessary.

First Embodiment

Figure 8:
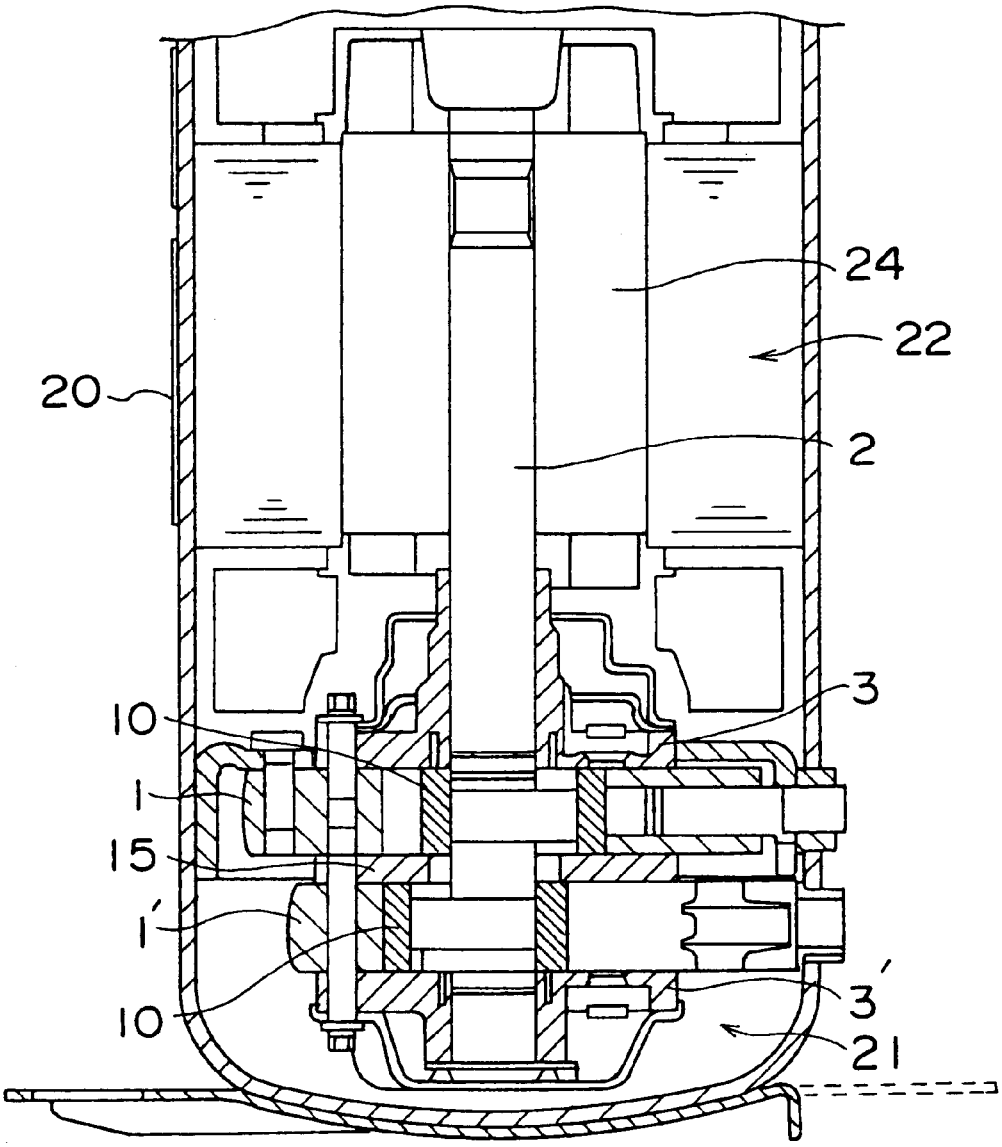
FIG. 8 is a longitudinal sectional view of an essential portion of a general compressor for a refrigeration system to which the present invention is applied.

A rotary compressor in a first embodiment according to the present invention will be described with reference to FIGS. 1 to 5 and 8 to 11. Referring to FIG. 8, the rotary compressor has a compressing mechanism 21, an electric motor 22 and a sealed case 20 containing the compressing mechanism 21 and the electric motor 22. The compressing mechanism 21 is driven for operation by a drive shaft (crankshaft) 2 connected to a rotor 24 included in the electric motor 22.

The compressing mechanism 21 has a pair of cylinders 1 and 1' disposed on the opposite sides of a partition plate 15, respectively. Each of the cylinders 1 and 1' has a shape substantially resembling a circular cylinder. The drive shaft 2 is extended through the cylinders 1 and 1'. Rollers 10 are placed in the cylinders 1 and 1' and mounted on the drive shaft 2 eccentrically to the axis of rotation of the drive shaft 2. When the drive shaft 2 rotates, the rollers 10 roll along the inner surfaces of the side walls of the cylinders 1 and 1', respectively.

Figure 9:
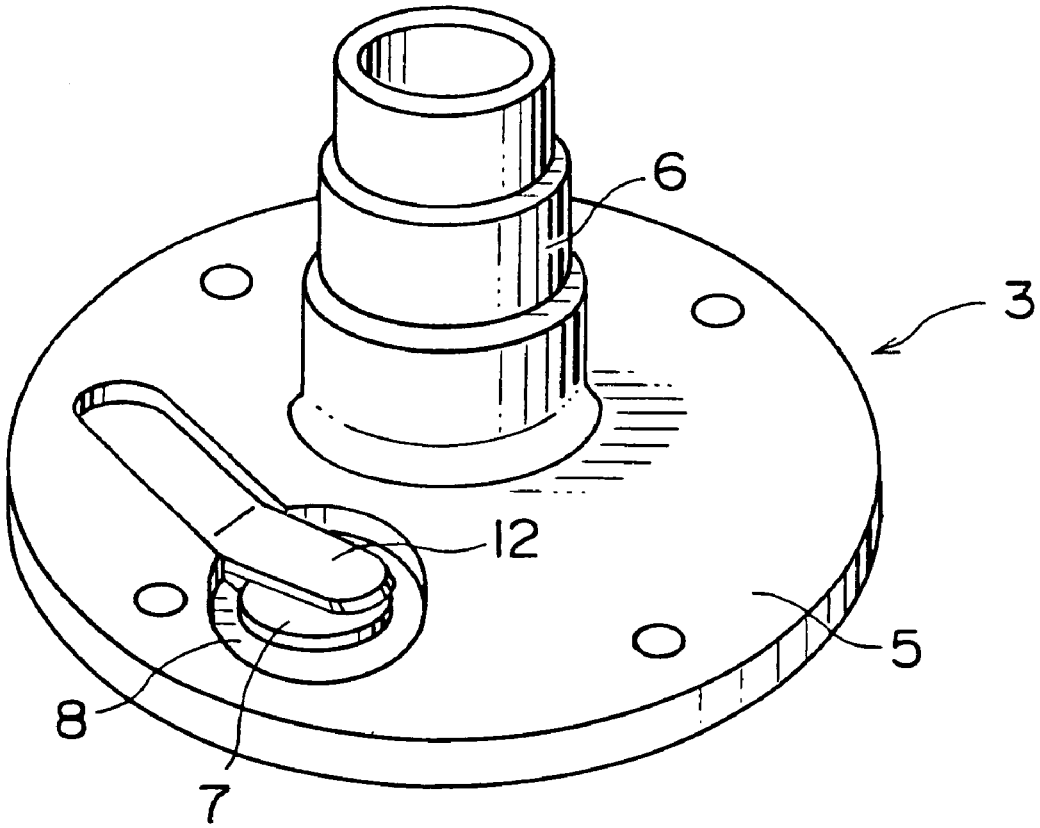
FIG. 9 is a perspective view of a main bearing member included in the compressor shown in FIG. 8.
Figure 10:
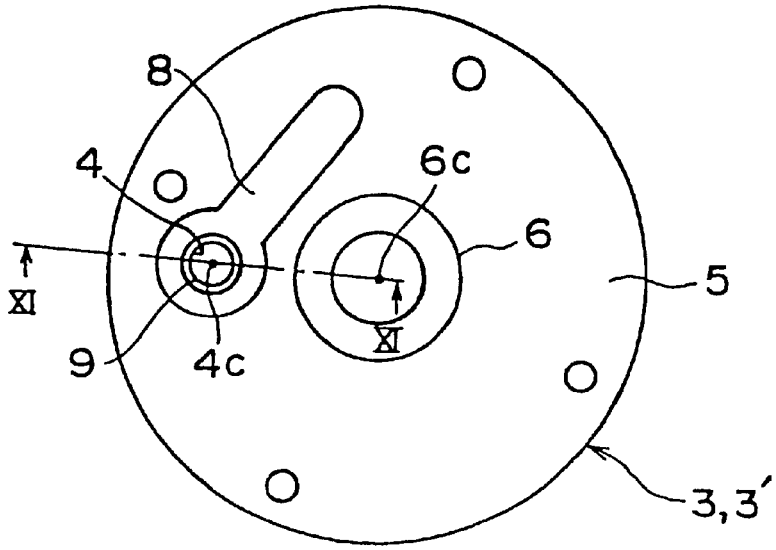
FIG. 10 is a plan view of a bearing member included in the compressor shown in FIG. 8.
Figure 11:
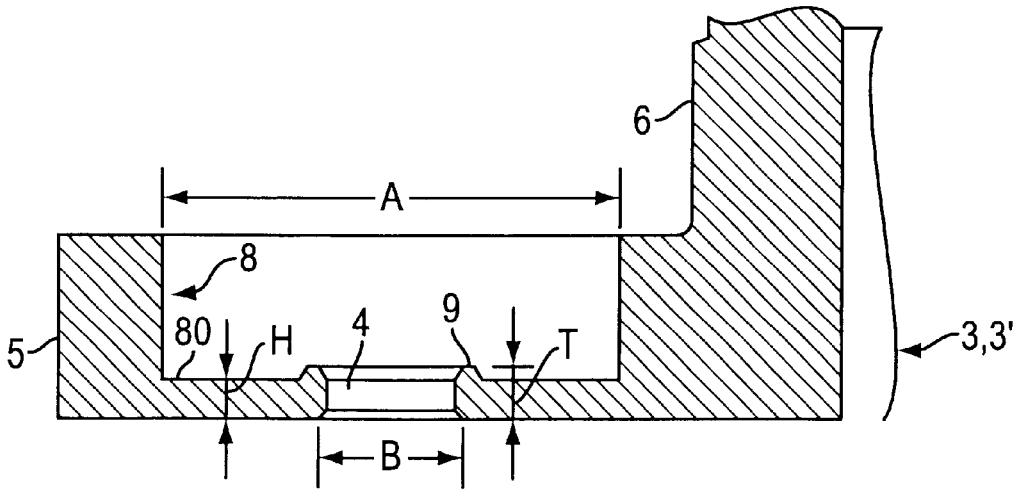
FIG. 11 is a sectional view taken on line XI—XI in FIG. 10.

A main bearing member 3 and an auxiliary bearing member 3' are disposed contiguously with the pair of cylinders 1 and 1', respectively. The bearing member 3 and the auxiliary bearing member 3' are basically similar in construction. Therefore only the bearing member 3 is shown in FIG. 9 and only the bearing member 3 will be described. As shown in FIG. 9, the bearing member 3 has a flange 5 joined to an end surface of the corresponding cylinder 1 (FIG. 8), and a bearing part 6 supporting the drive shaft 2. As shown in FIGS. 10 and 11, a discharge port 4 is formed through the flange 5. FIG. 11 is a fragmentary longitudinal sectional view taken on line XI—XI passing the center axis 6c of the bearing part 6 and the center axis 4c of the discharge port 4 in FIG. 10. As shown in FIG. 9, a discharge valve element 7 is attached to the flange 5 of the bearing member 3 to open and close the discharge port 4. A valve holder 12 is attached to the flange 5 to limit the opening of the valve element 7. A recess 8 corresponding to the discharge valve element 7 is formed in the flange 5. As shown in FIG. 11, a portion of the bottom surface 80 of the recess 8 around the outlet end of the discharge port 4 is raised to form a valve seat 9.

When the pressure of a refrigerant compressed in each of the cylinders 1 and 1' exceeds a predetermined discharge pressure, the discharge valve element 7 is forced to separate from the valve seat 9 to open the discharge port 4, and the compressed refrigerant is discharged through the discharge port 4 into the sealed case 20.

In this rotary compressor, discharge port 4, the recess 8 and the valve seat 9 are formed so that the ratio $H/A \geqq 0.07$, where H is the thickness of the bottom wall of the recess 8 and A is the width of the recess 8 in a longitudinal section (FIG. 11) taken on line XI—XI (FIG. 10) passing the center axis 6c of the bearing part 6 of the bearing member 3 and the center axis 4c of the discharge port 4, and the ratio $T/B \leqq 0.3$, where T is the thickness of the valve seat 9 and B is the diameter of the discharge port 4.

The principle, operation and effect of the compressor will be described hereinafter. The discharge valve element 7 is opened and the refrigerant is discharged through the discharge port 4 while the compressor is in the compression stroke, and the discharge valve element 7 closes in the final stage of the compression stroke. In this state, the high-pressure refrigerant remains in the discharge port 4. The refrigerant remaining in the discharge port 4 reverses into the compression chamber of the cylinder 1 (1') at a pressure lower than that of the refrigerant remaining in the discharge port 4 to reduce the COP of the refrigeration system. When the refrigerant remaining in the discharge port 4 reverses into the compression chamber, the refrigerant expands and generates noise to enhance the operating noise of the compressor. Accordingly, the reduction of the amount of the refrigerant that remains in the discharge port 4 after the completion of the discharge stroke is effective in improving the COP and reducing operating noise.

Figure 2:
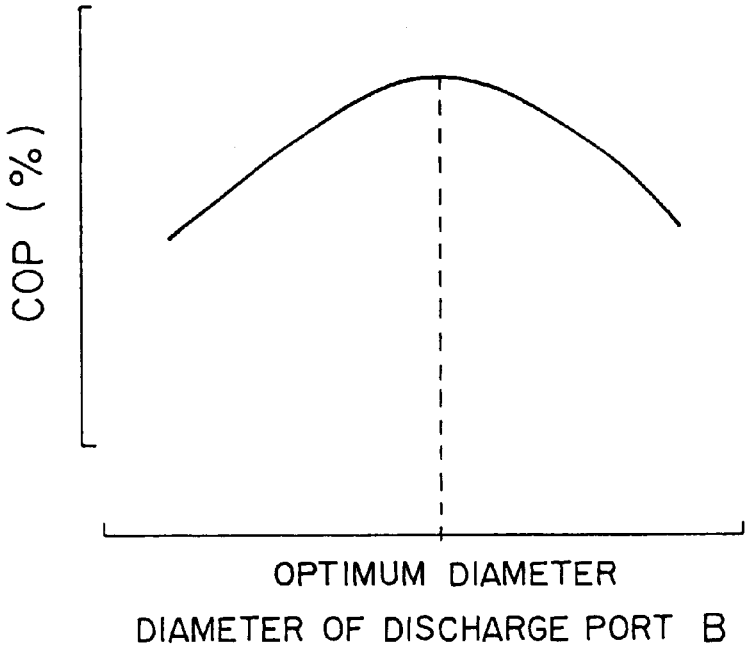
FIG. 2 is a graph of assistance in explaining the compressor in the first embodiment showing the variation of COP with the diameter B of a discharge port.

The amount of the refrigerant that remains in the discharge port 4 can be reduced by reducing the diameter B of the discharge port 4 or by reducing the thickness T of the valve seat 9, i.e., by reducing the length of the discharge port 4. The diameter B of the discharge port 4 affects greatly to the velocity of the refrigerant discharged through the discharge port 4 and resistance exerted by the discharge port 4 on the flow of the refrigerant. As shown in FIG. 2, there is an optimum diameter B that increases the COP to a maximum. Therefore, it is considered that the reduction of the thickness T of the valve seat 9 is the most effective means for reducing the amount of the refrigerant that remains in the discharge port 4 after the completion of the discharge stroke.

However, as mentioned above, the thickness T of the valve seat 9 is equal to the thickness H of the bottom wall of the recess 8 or is greater than the same to prevent cavitation. Therefore, if the thickness T of the valve seat 9 is reduced simply, the thickness H of the bottom wall of the recess 8 decreases accordingly. If the thickness T of the valve seat 9 is simply reduced and the thickness H of the bottom wall of the recess 8 is reduced accordingly, the deflection of the bottom wall of the recess 8 caused by pressure difference, i.e., the difference between the discharge pressure and the compression pressure in the cylinder 1 (1'), increases. The deflection of the bottom wall of the recess 8 of the bearing members 3 (3') permits the leakage of the refrigerant. Consequently, the COP is reduced and, in the worst case, it is possible that the bearing members 3 and 3' are broken. Therefore, the thickness T of the valve seat 9 must be reduced so that the bottom wall of the recess 8 may not excessively deflected and the ratio T/B is not greater than 0.30.

A theoretical maximum deflection W of the bottom wall of the recess 8 of the bearing member 3 (3') is expressed by:

$$W=\alpha\cdot(P/E)\cdot(A^4/H^3) \quad (1)$$

where a is deflection coefficient, P is the difference between the discharge pressure and the compression pressure in the cylinder 1 (1'), A is the width of the recess 8 in a section shown in FIG. 11, H is the thickness of the bottom wall of the recess 8 in a section shown in FIG. 11 and E is the Young's modulus (modulus of longitudinal elasticity) of the material forming the bearing member 3 (3').

Figure 3:
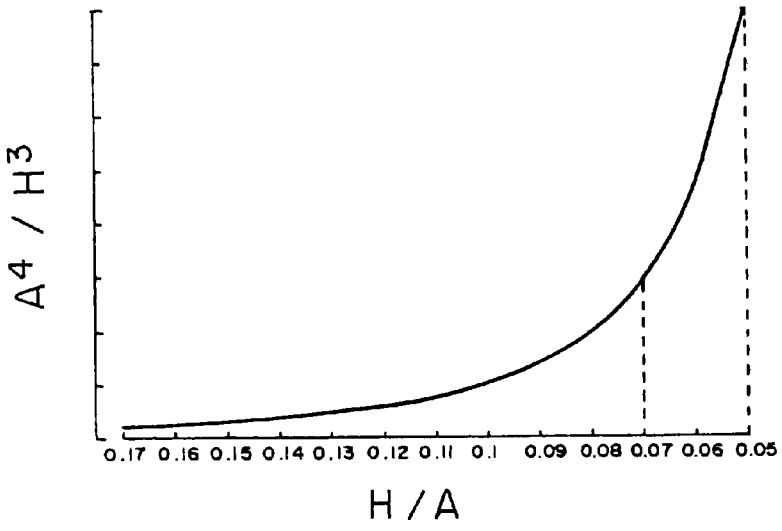
FIG. 3 is a graph of assistance in explaining the compressor in the first embodiment showing the relation between the ratios H/A and $A^4/H^3$.

It is known from Expression (1) that maximum deflection W of the bottom wall of the recess 8 increases in proportion to the ratio $A^4/H^3$. Supposing that the width A of the recess 8 is fixed, the ratio $A^4/H^3$ varies with the ratio H/A as shown in FIG. 3. As obvious from FIG. 3, the ratio $A^4/H^3$ increases sharply with the decrease of the ratio H/A after the ratio H/A decreases past 0.07.

FIG. 1 shows the relation between the variation of the noise level and the COP, and the ratios T/B and H/A when the diameter B of the discharge port 4 and the height (T−H) of the valve seat 9 from the bottom surface 80 of the recess 8 are fixed, and the thickness T of the valve seat 9 is varied. As obvious from FIG. 1, the noise level decreases as the ratio H/A decreases.

The COP increases with the decrease of the ratio H/A in a range where the ratio H/A is not smaller than 0.07. When the ratio H/A decreases below 0.07, the COP decreases due to the leakage of the refrigerant attributable to the deflection of the bottom wall of the recess 8 and, eventually, the bearing members 3 and 3' are broken.

According to the present invention, the bearing members 3 and 3' are formed so that the ratio H/A is not smaller than 0.07 and the ratio T/B is not greater than 0.3 to form the valve seats 9 in the thickness T smaller than that of the valve seats of the bearing members of the conventional compressor, suppressing the deflection of the bottom walls of the recesses 8 of the flanges 5 of the bearing members 3 and 3'. Consequently, the breakage of the bearing members 3 and 3' can be prevented, the COP of the refrigeration system provided with the compressor of the present invention is greater than that of a refrigeration system provided with an equivalent conventional compressor and the compressor generates noise of a level lower than that of noise generated by the equivalent conventional compressor.

Figure 4:
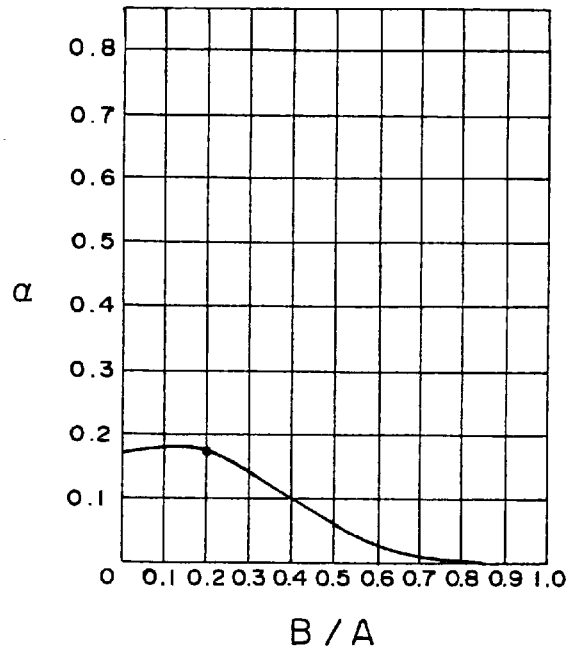
FIG. 4 is a graph of assistance in explaining the compressor in the first embodiment showing the variation of a deflection coefficient $\alpha$ and the ratio B/A.

It is preferable in view of further effectively suppressing the deflection of the bottom wall of the recess 8 to determine the width A of the recess 8, the diameter B of the discharge port 4, the thickness H of the bottom wall of the recess 8 and the thickness T of the valve seat 9 so that the ratio B/A is 0.2 or above. As obvious from Expression (1), the maximum deflection W is proportional to the deflection coefficient $\alpha$. The deflection coefficient $\alpha$ decreases sharply with the increase of the ratio B/A in a range of the ratio B/A beyond 0.2 as shown in FIG. 4. Therefore, the maximum deflection W of the bottom wall of the recess 8 can further effectively be reduced by forming the bearing members 3 and 3' so that the ratio B/A is 0.2 or above.

It is preferable, in view of further effectively suppressing the deflection of the bottom wall of the recess 8 and preventing the reduction of the COP, to form the bearing members 3 and 3' of a material having a Young's modulus of 70 GPa or above. As known from Expression (1), the maximum deflection W of the bottom wall of the recess 8 varies in inverse proportion to the Young's modulus E of the material forming the bearing members 3 and 3'. Accordingly, the greater the Young's modulus of the material, the smaller is the maximum deflection W as indicated by a lower curve in FIG. 5.

Figure 5:
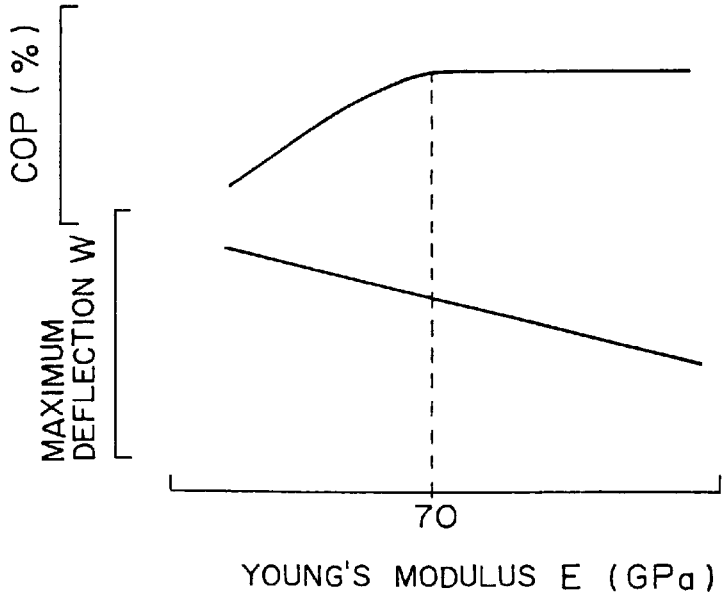
FIG. 5 is a graph of assistance in explaining the compressor in the first embodiment showing the variation of COP and maximum deflection W of the bottom wall of a recess formed in the flange of a bearing member with the Young's modulus of the material forming the bearing member.

Supposing that the design dimensions of the bearing members 3 and 3' are fixed, the coP decreases due to increase in the leakage of the refrigerant resulting from the deflection of the bottom wall of the recess 8 with the decrease of the Young's modulus E of the material in a range below 70 GPa, while the deflection of the bottom wall of the recess 8 is suppressed and the COP is stabilized when the Young's modulus E of the material is in a range not lower than 70 GPa as indicated by an upper curve in FIG. 5. Thus, the deflection of the bottom wall of the recess 8 can effectively suppressed and the reduction of the COP can be prevented by forming the bearing members 3 and 3' of a material having a Young's modulus E of 70 GPa or above. Materials having Young's moduli of 70 GPa or above for forming the bearing members 3 and 3' are cast irons, aluminum and iron-base sintered metals.

Second Embodiment

A compressor in a second embodiment according to the present invention will be described with reference to FIGS. 6 and 7, in which parts like or corresponding to those of the general compressor shown in FIGS. 8 to 11 are designated by the same reference characters and the description thereof will be omitted.

Figure 6:
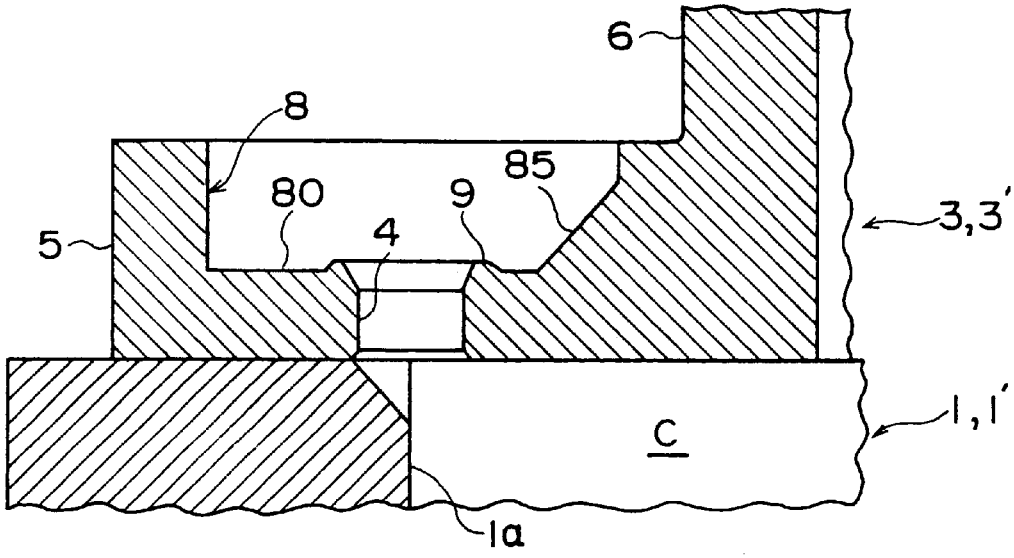
FIG. 6 is a longitudinal sectional view of an essential potion of a compressor in a second embodiment according to the present invention for a refrigeration system.

Referring to FIG. 6 showing essential portions of a cylinder 1 (1') and a bearing member 3 (3') in a sectional view similar to that shown in FIG. 11, the bearing member 3 (3') has a flange 5 provided with a recess 8 and a discharge port 4. A valve seat 9 is formed around the discharge port 4. A portion of the bottom surface of the recess 8 extending between the valve seat 9 and a bearing part 6, i.e., a portion of the bottom surface overlying a compression chamber C surrounded by the inner surface 1*a* of the cylinder 1 (1'), is inclined upward toward the bearing part 6 to form a reinforcing part 85 having a thickness greater than that of the bottom wall of the recess 8. The thickness of the reinforcing part 85 increases continuously toward the bearing part 6. The dimensions of the reinforcing part 85 are determined so that the reinforcing part 85 may not interfere with a discharge valve element 7 (FIG. 9) placed in the recess 8.

Figure 7:
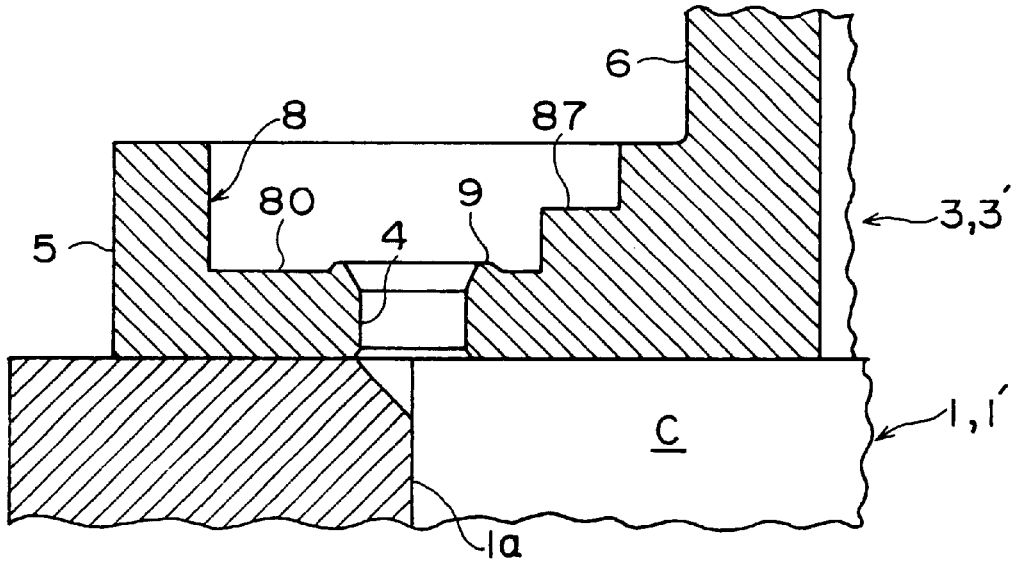
FIG. 7 is a longitudinal sectional view of an essential portion of a compressor in a modification of the compressor shown in FIG. 6.

In a modification shown in FIG. 7, a reinforcing part 87 having the shape of a step is formed instead of the reinforcing part 85 having the shape of a slope in the portion of the bottom surface of the recess 8 extending between the valve seat 9 and the bearing part 6. A reinforcing part having the shape of a plurality of steps may be formed instead of the reinforcing part 87 having the shape of a single step.

The reinforcing part 85 (87) formed in the recess 8 between the valve seat 9 and the edge of the recess 8 on the side of the bearing part 6 enhances the rigidity of the bottom wall of the recess 8 of the flange 5 of the bearing member 3 (3'). Therefore, the thickness T (FIG. 10) of the valve seat 9 may be smaller than that of the valve seat of a bearing member included in an equivalent conventional compressor. Thus, the breakage of the bearing members 3 and 3' can be prevented, the COP of the refrigeration system provided with the compressor of the present invention is greater than that of a refrigeration system provided with an equivalent conventional compressor and the compressor generates noise of a level lower than that of noise generated by the equivalent conventional compressor.

Since the deflection of the bottom walls of the recesses 8 formed in the flanges 5 of the bearing members 3 and 3' can be suppressed, the leakage of the refrigerant can be limited to the least unavoidable extent even if the refrigerant having a pressure higher than that of R22, i.e. hydrof luorocarbon (HFC) such as R410, is used as a working fluid of the compressor. The effect of the present invention in improving the COP is particularly remarkable when a high-pressure refrigerant is employed.

Although the invention has been described as applied to a two-cylinder rotary compressor, it goes without saying that the present invention is applicable also to a single-cylinder rotary compressor provided with a single cylinder and a single bearing member having a discharge port and a discharge valve element.

Although the invention has been described in its preferred embodiments with a certain degree of particularity, obviously many changes and variations are possible therein. It is therefore to be understood that the present invention may be practiced otherwise than as specifically described herein without departing from the scope and spirit thereof.

What is claimed is:

1. A compressor for a refrigeration system, said compressor comprising:

a cylinder having a shape substantially resembling a circular cylinder;

a drive shaft extended through the cylinder;

a bearing member joined to an end of the cylinder, having a flange provided with a discharge port, and a bearing part supporting the drive shaft; and a discharge valve element held on the flange to open and close the discharge port;

wherein the flange of the bearing member is provided with a recess corresponding to the discharge valve element, and a valve seat formed by raising a portion of the bottom surface of the recess around the discharge port, the ratio $H/A \geqq 0.07$, where H is thickness of a bottom wall of the recess and A is width of the recess in a longitudinal section taken on line passing a center axis of the bearing part and a center axis of the discharge port, and the ratio $T/B \leqq 0.3$, where T is thickness of the valve seat and B is diameter of the discharge port.

2. A compressor for refrigeration system, said compressor comprising:

a cylinder having a shape substantially resembling a circular cylinder;

a driver shaft extended through the cylinder;

a bearing member joined to an end of the cylinder, having a flange provided with a discharge port, and a bearing part supporting the drive shaft; and a discharge valve element held on the flange to open and close the discharge port;

wherein the flange of the bearing member is provided with a recess corresponding to the discharge valve element, and a valve seat formed by raising a portion of the bottom surface of the recess around the discharge port, the ratio $H/A \geqq 0.07$, where H is thickness of a bottom wall of the recess and A is width of the recess in a longitudinal section taken on line passing a center axis of the bearing part and a center axis of the discharge port, and the ratio $T/B \leqq 0.30$, where T is thickness of the valve seat and B is diameter of the discharge port;

wherein the bearing member is formed of a material having a Young's modulus of 70 Gpa or above.

3. The compressor for a refrigeration system according to claim 2, wherein the ratio $B/A \geqq 0.2$, where B is the diameter of the discharge port and A is the width of the recess.

4. The compressor for a refrigeration system according to claim 2, wherein the material forming the bearing member is a cast iron.

5. The compressor for a refrigeration system according to claim 2, wherein the material forming the bearing member is aluminum.

6. The compressor for a refrigeration system according to claim 2, wherein the material forming the bearing member is an iron-base sintered metal.

7. The compressor for a refrigeration system according to claim 2, wherein a refrigerant having a pressure higher than that of R22 is used as a working fluid of the compressor.

* * * * *